US006889772B2

(12) United States Patent
Buytaert et al.

(10) Patent No.: US 6,889,772 B2
(45) Date of Patent: May 10, 2005

(54) METHOD AND APPARATUS FOR INSTALLING CONTROL LINES IN A WELL

(75) Inventors: Jean Buytaert, Stonehaven (GB); Luciano Spadoni, Fara Gera d'Adda (IT); Edward Sinclair, Stonehaven (GB)

(73) Assignee: Frank's International, Inc., Houston, TX (US)

( * ) Notice: Subject to any disclaimer, the term of this patent is extended or adjusted under 35 U.S.C. 154(b) by 34 days.

(21) Appl. No.: 10/278,718

(22) Filed: Oct. 23, 2002

(65) Prior Publication Data

US 2004/0079533 A1 Apr. 29, 2004

(51) Int. Cl.[7] ..... E21B 19/02
(52) U.S. Cl. ..... 166/381; 166/77.57; 175/52
(58) Field of Search ..... 166/380, 77.51, 166/77.52, 77.53, 85.1, 381; 175/52, 162, 189, 202

(56) References Cited

U.S. PATENT DOCUMENTS

| | | | | |
|---|---|---|---|---|
| 3,722,584 A | | 3/1973 | Nelson | |
| 3,722,603 A | | 3/1973 | Brown | |
| 3,742,563 A | * | 7/1973 | Brown | 188/67 |
| 4,106,575 A | | 8/1978 | Bunnelle | |
| 4,274,778 A | | 6/1981 | Putnam et al. | |
| 4,281,716 A | | 8/1981 | Hall | |
| 4,450,606 A | * | 5/1984 | Broussard | 188/67 |
| 4,715,625 A | * | 12/1987 | Shows et al. | 285/123.11 |
| 4,938,109 A | | 7/1990 | Torres et al. | |
| 5,503,234 A | | 4/1996 | Clanton | |
| 5,732,909 A | | 3/1998 | Sonnier | |
| 6,089,338 A | * | 7/2000 | Bouligny, Jr. | 175/423 |
| 6,131,664 A | | 10/2000 | Sonnier | |
| 6,138,776 A | * | 10/2000 | Hart et al. | 175/85 |
| 6,279,662 B1 | | 8/2001 | Sonnier | |
| 6,443,241 B1 | * | 9/2002 | Juhasz et al. | 175/52 |
| 6,471,439 B2 | * | 10/2002 | Allamon et al. | 403/374.1 |
| 6,637,526 B2 | * | 10/2003 | Juhasz et al. | 175/52 |

FOREIGN PATENT DOCUMENTS

| | | |
|---|---|---|
| GB | 296171 | 8/1928 |
| WO | WO 00/19061 | 4/2000 |

OTHER PUBLICATIONS

International Search Report; International application no PCT/US03/33647; International filing date Oct. 23, 2003; 4 pages.

* cited by examiner

*Primary Examiner*—Frank Tsay
(74) *Attorney, Agent, or Firm*—Streets & Steele; Patrick K. Steele; Frank J. Campigotto

(57) ABSTRACT

A method and apparatus are provided for installing control lines and pipe into a well. The pipe-holding spider that is normally mounted on the rig floor is supportably retained in a vertically movable retainer. The retainer is adapted for controllably elevating the spider above the rig floor when the pipe slips within the spider are not engaged with the outer surface of the pipe string, thereby providing personnel access to a portion of the length of the pipe string below the elevated spider and above the rig floor. Personnel are provided with access to the pipe string for applying a fastener to secure the control line to the pipe string.

35 Claims, 4 Drawing Sheets

METHOD AND APPARATUS FOR INSTALLING CONTROL LINES IN A WELL

BACKGROUND OF THE INVENTION

1. Field of the Invention

The present invention relates to a method and apparatus for installing pipe and control line in a well. More specifically, the present invention relates to a method and apparatus for installing control lines secured to a string of pipe as the pipe is being made up and run into a well.

2. Background of the Related Art

Oil and gas wells may be equipped with control lines for electrically, hydraulically or optically linking various downhole devices to the surface. Control lines may be used to receive data from downhole instruments and to selectively operate from the surface downhole devices such as valves, switches, sensors, relays or other devices. One use of control lines is to open, close or adjust downhole valves in order to selectively produce or isolate formations at locations deep in the well. A control line may transmit downhole data to the surface and communicate commands to the same or other downhole devices. The control line may comprise conductive wires or cables for electrically controlling downhole devices, fibers for optically controlling downhole devices, or small-diameter tubing for hydraulically controlling downhole devices. Control lines are generally of a small diameter relative to the diameter of the pipe string to which they are secured, and are generally between 0.5 and 6 cm. in diameter. Control lines are generally secured along the length of the outer surface of a pipe string, generally parallel to the center axis of the bore of the pipe string. Continuous control lines are secured to the pipe string and installed in the well as joints of metal pipe are made up into a pipe string and run into a well. Control lines secured to pipe string are subject to being damaged and useless if pinched or crushed, by pipe slips used to grip and support the pipe string while it is being made up and run into the well.

The spider is a device used on a drilling or workover rig for gripping and supporting the pipe string as joints of pipe are made up into the pipe string. The spider has an interior bore, generally aligned with the pipe string, through which the pipe string passes. The spider has a circumferential arrangement of radially inwardly movable pipe slips disposed around the pipe string and within the internal bore. The pipe slips move radially inwardly to circumferentially grip the outer surface of the pipe string and support the pipe string in the well when the pipe string is not supported by the elevator. It is important that the pipe slips in the spider uniformly engage and grip the pipe string in order to prevent crushing or damaging the pipe making up the pipe string. Each pipe slip within the internal bore of the spider applies a force radially inwardly against the outer surface of the pipe string. It is important that the pipe slips are concave in order to contact the pipe over as large an interval as possible in order to minimize the localized stress imposed on the pipe by the pipe slips.

If a control line becomes pinched or trapped between the pipe slips of the spider and the outer surface of the pipe string, or if a control line is pinched between adjacent segments of the pipe slips as they move radially inwardly to contact the pipe string, the control line may be damaged and surface control of downhole devices may be lost or impaired. It is important that the method used to secure control lines to the pipe string be designed to prevent control line damage.

One method of installing continuous control lines as the pipe string is made up and run into the well requires that the control lines extend along the portion of the pipe string where the pipe string is held in the internal bore of the spider. A control line is circumferentially positioned along the length of the outer surface of the pipe string to coincide with a gap or recess formed in the radially outwardly disposed portion of the pipe slips and sized to accommodate the control line. This method is satisfactory for a single control line or for multiple control lines that are flexible and pliable enough to be bundled together using an arrangement of positioning arms and control line guides to redirect control lines to the desired generally parallel configuration to be received within the gap or recess. However, this method is unsatisfactory for applications requiring multiple control lines being unspooled and fed from more than one location adjacent to the spider where the control lines are more stiff or otherwise resistant to being redirected and positioned using positioning arms and guides. Also, the gap or recess formed in the radially outwardly disposed portion of the pipe slips is of limited size and is insufficient to accommodate multiple control lines required for controlling multiple downhole devices.

In many installations, it is desirable to secure multiple control lines along the length of the outer surface of the pipe string in order to allow surface control of multiple downhole devices. Multiple control lines are especially useful in deep offshore wells that penetrate multiple formations. Existing designs may require four or more control lines for each string of pipe that is run into the well. Multiple control lines are most efficiently made, stored, transported and installed in bundles comprising control lines coupled together in a generally parallel, side-by-side configuration. Multiple control lines require larger clamps to secure the bundle along the length of the outer surface of the pipe string.

A method has been developed for securing control lines to a pipe string as the pipe string is made up and run into a well. U.S. Pat. No. 6,131,664 ("the '664 Patent") is directed to using an elevated work platform constructed on the rig floor. The work platform is equipped with hydraulic tongs for making up the pipe string, and an opening above the well in the floor of the work platform that is generally aligned with the well and with an opening in the rig floor beneath the work platform. The work platform disclosed in the '664 Patent supports the spider and, when the pipe string is supported by the spider, the work platform must support the weight of entire pipe string. This requires the work platform to be built to support 200 tons or more. The work platform described in the '664 Patent also requires sufficient work area for rig personnel to use the tongs to make up joints of pipe that are lowered and aligned in position above the pipe string to be threadably made up into the pipe string.

The '664 Patent discloses that control lines are provided to the pipe string from a separate work area maintained on the rig floor and below the level of the work platform. The control lines are stored on and continuously provided from spools located lateral to the pipe string and adjacent to the opening in the rig floor. Clamps are installed by rig personnel working in the work area beneath the work platform to secure the control lines to the pipe string.

The problem with the method and apparatus for installing control lines described in the '664 Patent is that the work platform must be extremely structurally robust to support the enormous weight of the entire pipe string, the control line, the spider, and the rig personnel making up the pipe string. The erection of the work platform consumes a large amount of rig time during which no progress is made in completing the well. After the control lines and pipe string are run into the well, the work platform must be removed from the rig floor, thus consuming additional rig time. Another problem with the method and apparatus disclosed in the '664 Patent is that rig personnel working on the elevated work platform are dangerously impaired from escaping well blowout or other a well control situation.

What is needed is a method of safely securing control lines to a pipe string as the pipe string is being made up and run into a well. What is needed is a method of securing control lines to a pipe string that does not require the erection, removal or use of a special work platform for providing a work area for rig personnel that is separate from the rig floor. What is needed is a method of securing control lines to a pipe string as it is being made up and run in a well that eliminates the need for an elevated work platform strong enough to support the entire pipe string. What is needed is a method of securing control lines along the length of a pipe string as it is being made up and run in a well that eliminates obstructions to escape routes to be used by rig personnel in the event of a well blowout or other well control situation. What is needed is a method and an apparatus that enables the safe and inexpensive installation of control lines that are secured to a pipe string as it is being made up and run into a well.

SUMMARY OF THE PRESENT INVENTION

The method and apparatus of the present invention allows one or more control lines to be secured along the length of a pipe string as the pipe string is being made up and run into a well. The method and apparatus of the present invention allows control lines to be secured to a pipe string above the rig floor and below the spider, but eliminates the need for an elevated work platform strong enough to support the enormous weight of the pipe string. The method and apparatus of the present invention improves rig safety by preventing impairment of escape routes on the rig floor.

In the method and apparatus of the present invention, the spider is received within and supportable by a vertically reciprocating retainer. The retainer is adapted to distribute the load on the spider to structural components in or under the rig floor when the pipe string is supported by the spider, and to vertically displace and support the spider when the spider is disengaged from the pipe string and the weight of the pipe string is supported by the elevator. The disengaged spider may be controllably elevated using the retainer to support the spider at a distance above the rig floor to permit rig personnel access to the outer surface of the portion of the pipe string located below the elevated spider and above the rig floor. Access to the outer portion of the pipe string below the spider and above the rig floor permits rig personnel to install fasteners to secure control lines to the pipe string.

Control lines are provided to the pipe string from spools located on or near the rig floor and generally lateral to the pipe string. Optionally, control lines are routed or threaded over roller guides in the retainer to strategically align the control lines along the length of the pipe string so that the control lines can be secured to the pipe string. Control lines are secured to the pipe string with fasteners, such as clamps, sleeves, bands, clips or other fasteners and installed by rig personnel working beneath the elevated spider, but in the same area of the rig floor used by rig personnel to operate the tongs and to make up joints of pipe into the pipe string. Control lines may be secured along the outer surface of the pipe string at any radial or circumferential location without regard to the points of contact between the outer surface of the pipe string and the pipe slips within the internal bore of the spider. Additionally, fasteners used to secure control lines to the pipe string may be designed independent of restrictions imposed by the size or configuration of the internal bore of the spider.

The foregoing, as well as other, objects, features, and advantages of the present invention will be more fully appreciated and understood by reference to the following drawings, specification and claims.

DETAILED DESCRIPTION

Figure 1:
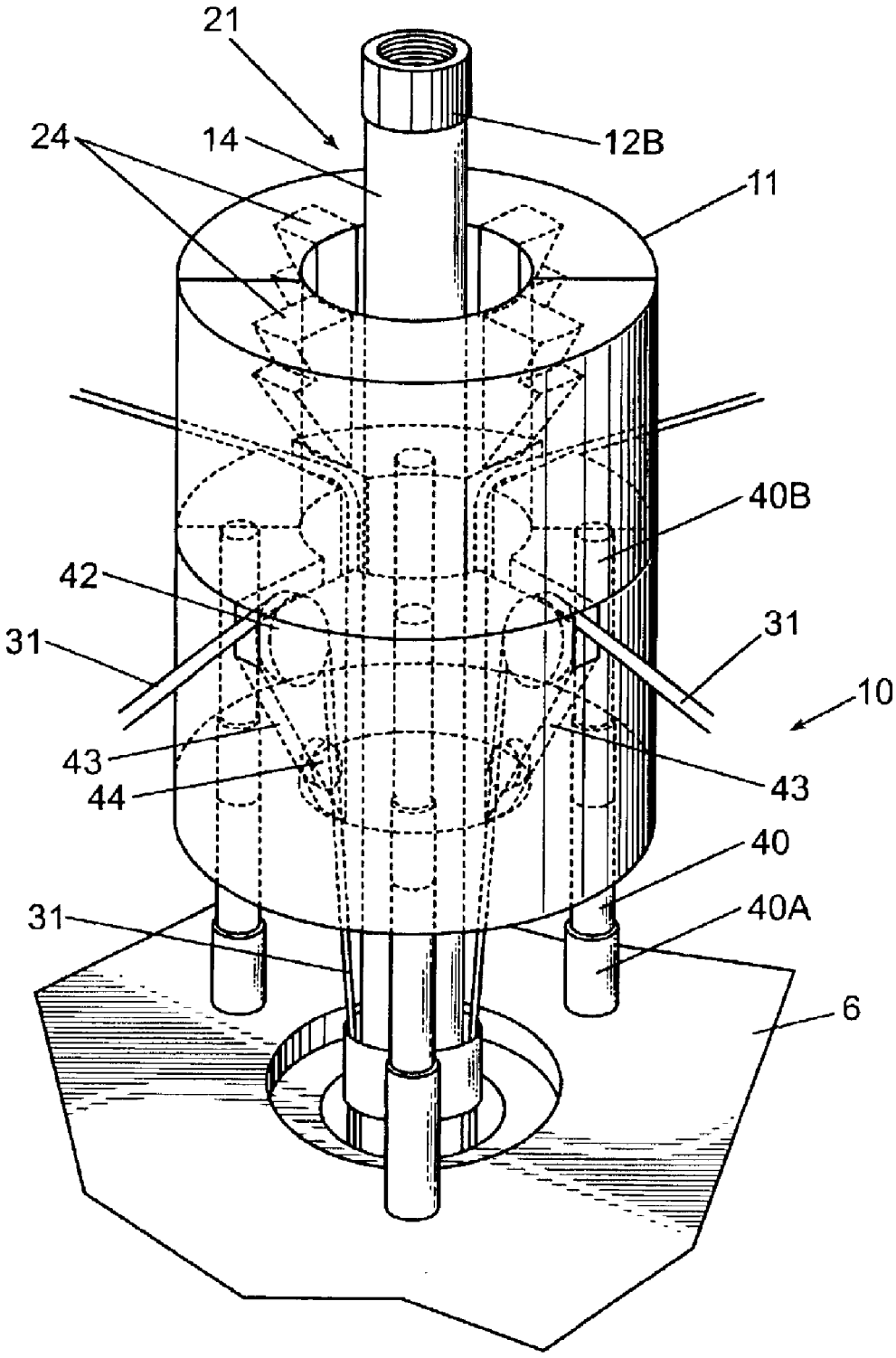
FIG. 1 is a perspective view, partially in section, of the vertically reciprocating spider retainer of the present invention, with a spider received therein.

Wells are generally drilled deep into the earth's crust to establish fluid communication between the surface and sub-surface geologic formations containing naturally occurring hydrocarbon deposits, such as oil or gas. A well provides a fluid conduit allowing subsurface deposits of oil and gas to be produced at the surface. It is common for a drilled borehole to penetrate a plurality of formations. Formations may contain hydrocarbons or other fluids of different compositions and at different pressures than the hydrocarbons and fluids contained in other formations. Formations may also contain water (aquifers), brine, hydrogen sulfide gas and other materials that may be undesirable.

A drilled borehole is completed into a well by circulating cement into the annulus between the wall of the drilled borehole and the outer surface of a pipe string called casing to form a cement liner. The cement hardens to isolate penetrated formations from flowing into the well and to the surface. Once a borehole is drilled and completed, decisions are made as to which of the penetrated formations to selectively produce. A perforating tool is used to cut a hole through the casing and the cement liner to selectively establish fluid communication between the targeted formation and the surface. Once a formation is perforated, the well may be produced to (pressure) depletion, until it "waters out" by increasing water content, or both. Once a formation is depleted or watered out, it may be desirable to intervene in the well to alter or isolate the formation so that other formations may be perforated and produced without the production being burdened by fluid losses into depleted formations or by water intrusion from watered out formations. Intervention is generally performed by wire line unit (WLU) workover, coiled tubing unit (CTU) workover or by a conventional workover rig. A WLU or CTU workover is performed by lowering an instrument or tool into the well using a specialized rig having a long spooled wire line or tubing for connecting or controlling the downhole instrument or tool from the surface. The conventional workover rig generally requires that all production tubing be removed from the well so that tools or instruments may be run into the well on a work string.

If the depleted or watered-out formations lower in the well than the formation, the depleted or watered-out formation may be isolated from the well by using one of the three conventional intervention techniques described above. In a conventional intervention workover, material such as cement or sand may be deposited into the bottom of the well to form a plug to seal off the perforations in the depleted or watered-out formation, and to thereby isolate the depleted or watered-out formation from the new formation located above. Once a sand or cement plug is in place, another workover may be required to later remove it. Packers are tools that can be installed in a well during a workover to isolated, depleted or watered-out formations.

Conventional workovers to install or remove downhole plugs or packers are unnecessary if formations can be isolated or remotely controlled using downhole devices. Downhole devices, such as valves or chokes, may be installed in a pipe string as it is being made up and run into a well to enable the selective production, isolation or flow-control of fluids residing in the formations penetrated by a well. Surface-controlled downhole valves or chokes require continuous control lines that extend from the surface through the well to the depth at which the downhole devices are installed in the pipe string. Control lines must be installed as the pipe string is being made up and run into the well.

Continuous control lines are generally stored and transported to the rig location on spools. The spools of control line are generally mounted on a horizontal axle on or near the rig floor so that the control line may be easily and smoothly "fed" to the pipe string being fastened to the pipe string by reeling of the spool.

FIG. 1 is a perspective view, partially in section, of one embodiment of the vertically reciprocating spider retainer 10 of the present invention, with a spider received therein, and in its raised or elevated position. The retainer 10 may be integral with the spider 11, as shown in FIG. 1, or it may be a separate device adapted to supportably receive the spider 11. In the embodiment shown in FIG. 1, the retainer 10 is supportable with four hydraulically powered telescoping legs 40 angularly distributed around the periphery of the retainer 10 for even support. The legs 40 are designed to telescope and retract in unison for smooth and controlled elevation and return of the retainer 10 and the spider 11 supported in the retainer 10. Each leg 40 is coupled at a stationary end 40A to the rig floor 6 or other structural component of the rig, and coupled at a traveling end 40B to the retainer 10. Control lines 31 are provided to the retainer 10 from spools (not shown) located on the rig floor and laterally to the retainer 10 and the pipe string 14. The control lines 31 are threaded around an upper roller guide 42 received within a recess in the retainer 10 near the radially outwardly periphery of the retainer 10, a lower roller guide 44 received within a recess in the retainer 10 nearer to the internal bore of the retainer 10, and strategically directed from the lower roller guide 44 to generally lay flat along the length of the outer surface of the pipe string 14. It should be noted that a variety of tools or devices may be used in place of or in cooperation with the roller guides 42 and 44 to bend and direct the control lines 31 to their intended shape or configuration for being secured to the pipe string 14 and run into the well. Persons skilled in the art will appreciate the use of shaped guides, roller guides, cable funnels and the like to position and configure control lines.

In the embodiment illustrated in FIG. 1, the pipe slips 24 are disposed within the spider 11 in a generally distributed arrangement within the internal bore of the spider 11. The pipe slips 24 are radially inwardly movable to forceably engage the outer surface of the pipe string 14 to grip the pipe string 14 and support the pipe string 14 when the weight of the pipe string 14 is not supported by the elevator 5. (shown in FIG. 2)

Figure 2:
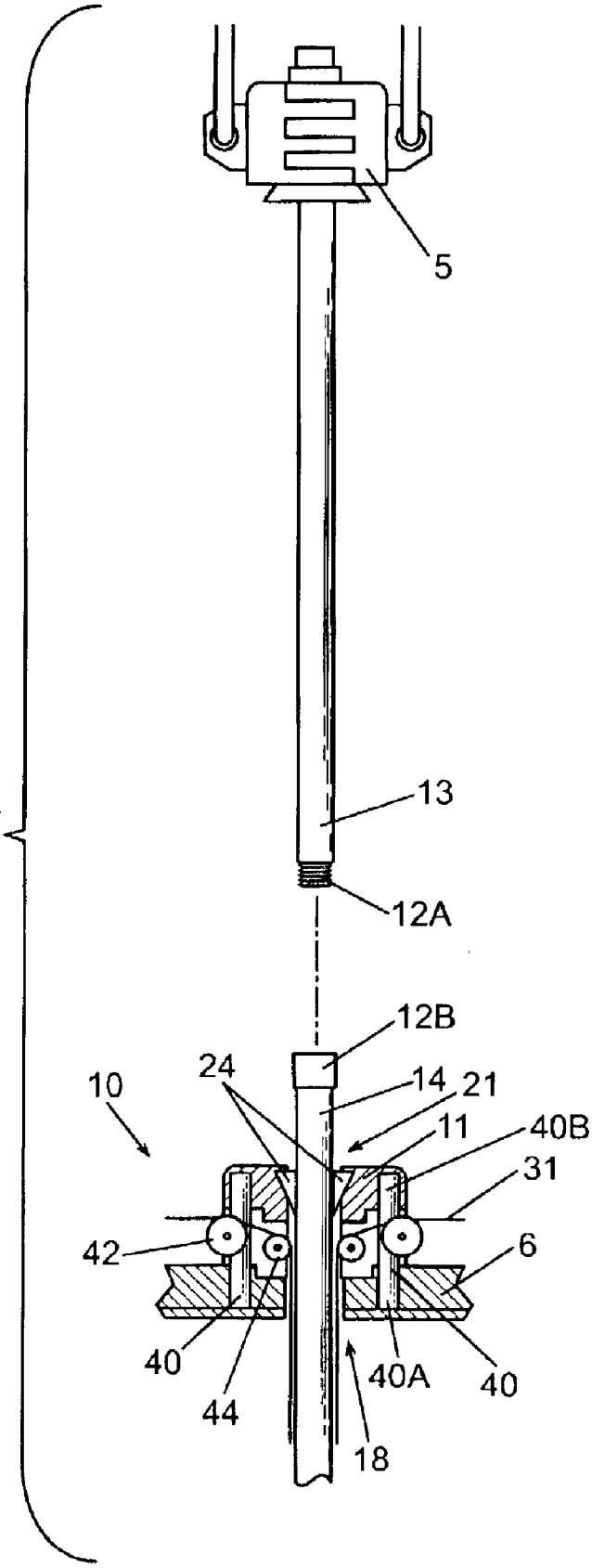
FIG. 2 is a side elevational view of the vertically reciprocating spider retainer of the present invention, with a spider received therein, in its floor position as a joint of pipe supported by the elevator is aligned with the pipe string and lowered to be threadably coupled to the pipe string.

FIG. 2 is a side elevational view of one embodiment of the vertically reciprocating spider retainer 10 of the present invention, with a spider received therein, and in its floor position as a joint of pipe 13 supported by the elevator 5 is aligned with the pipe string and lowered to be threadably coupled to exposed end of the pipe string 14. A rig floor 6 supports the vertically reciprocating retainer 10 that, in turn, supports the spider 11. The spider 11 rests in and is supported in the retainer 10, and the retainer 10 is adapted to be vertically elevated and supported by one or more telescoping legs 40. The legs 40 controllably vary in length to controllably elevate the retainer 10 to its raised position above the rig floor 6.

Referring to FIG. 2, a joint of pipe 13 having a downwardly disposed threaded male connection 12A is shown supported by the elevator 5 and being lowered into position to be threadably coupled to the pipe string 14. The threaded male connection 12A is received and screwed into the threaded coupling 1B coupled to the upwardly exposed end of the pipe string 14.

Personnel working on the rig floor 6 employ a hydraulically-powered set of tongs (not shown) to apply make-up torque to the pipe 13 and threadably couple it to the threaded coupling 12B to join pipe 13 into the pipe string 14. The rig floor 6 immediately adjacent to the retainer 10 provides a work area for rig personnel operating the hydraulic tong assembly to torque up the pipe string 14 by sequentially coupling additional joints of pipe 13.

Figure 3:
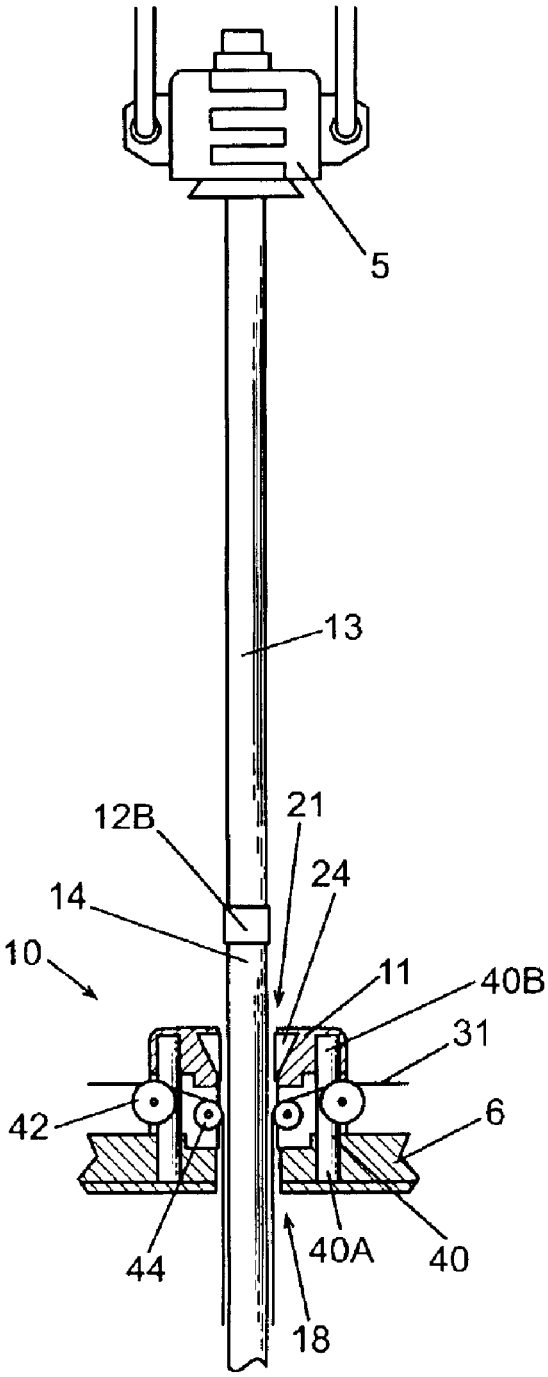
FIG. 3 is a side elevational view of the vertically reciprocating spider retainer of the present invention, with a spider received therein, in its floor position with the pipe string supported by the elevator after the pipe slips in the bore of the spider are disengaged from the outer surface of the pipe string.

In the preferred embodiment of the present invention shown in FIGS. 2–6, the retainer 10 is movably supported by four hydraulically telescoping legs 40. The legs 40 are designed to position the retainer 10 in its floor position (as shown in FIGS. 2 and 3) for engaging the pipe slips 24 of the spider 11 with the pipe string 14. When the pipe string 14 is supported by the elevator 5, the legs 40 may telescope to elevate or raise the retainer 10 and the spider 11 supported therein to the intermediate position (shown in FIG. 4) and, at the extreme length, to support the retainer 10 and the spider 11 in the raised position (shown in FIG. 5). The horizontal spacing between adjacent legs 40 shown in FIGS.

2–6 provides up to four generally rectangular openings through which control lines 31 may be provided from spools (not shown) located laterally to the pipe string 14. The spools may be set at different locations around the opening 18 in the rig floor 6. Using pulleys and roller guides, two or more spools may provide two or more feeds of control lines 31 through the same opening FIG. 3 is a side elevational view of the preferred embodiment of the vertically reciprocating spider retainer 10 of the present invention in its floor position with the pipe string 14, now comprising the pipe 13, supported by the elevator 5 after the pipe slips 24 in the internal bore of the spider 11 are disengaged from the outer surface of the pipe string 14. The control lines 31 are threaded over the outer roller guide 42, over the inner roller guide 44, and strategically directed downwardly from the inner roller guide 42 along the length of the pipe string 14.

Figure 4:
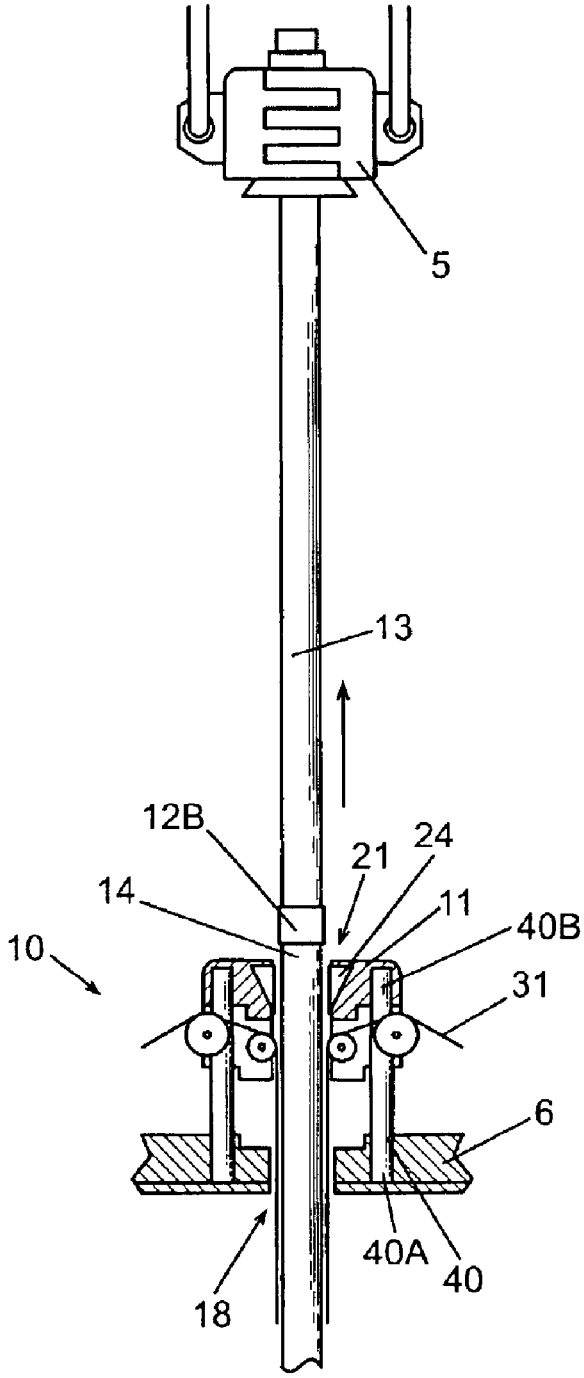
FIG. 4 is a side elevational view of the vertically reciprocating spider retainer of the present invention, with a spider received therein, with the pipe slips disengaged from the outer surface of the pipe string and as the retainer and the spider are elevated from the floor position towards the raised position.
Figure 5:
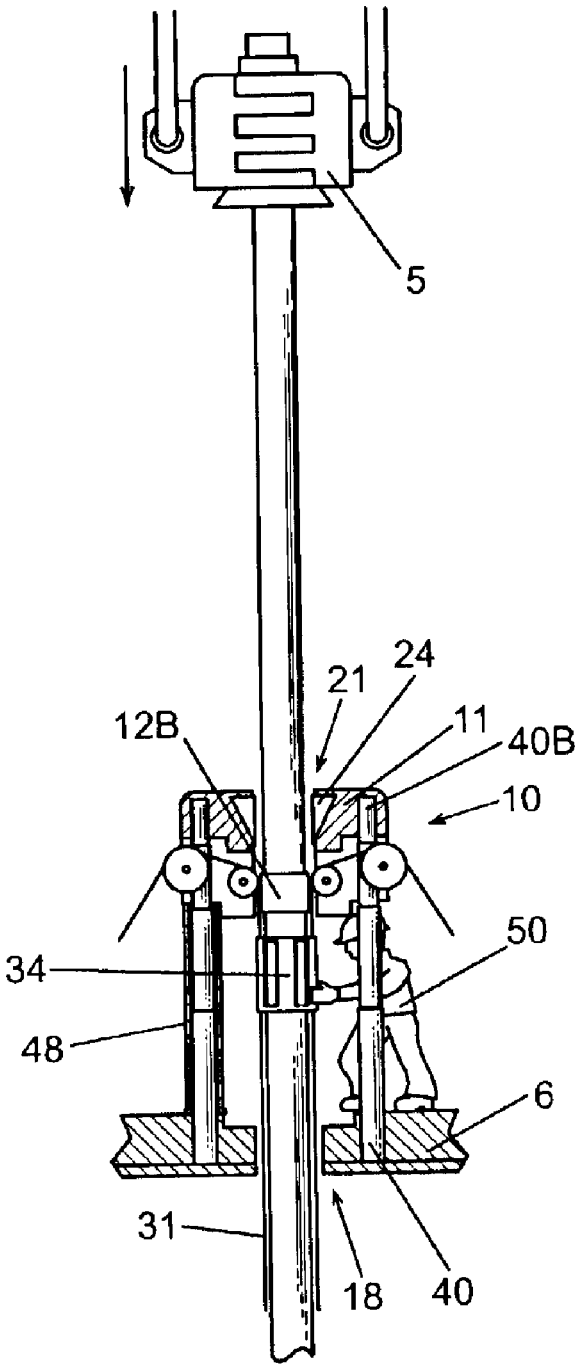
FIG. 5 is a side elevational view of the vertically reciprocating spider retainer of the present invention, with a spider received therein, with the vertically reciprocating spider retainer supporting the spider at the raised position thereby providing rig personnel access to a portion of the length of the pipe string below the spider and above the rig floor for installing a control line fastener.

The legs 40 that support and raise the retainer 10 are adapted for imparting generally vertical displacement of the retainer 10 and the spider 11 when the pipe slips 24 of the spider 11 are disengaged from the pipe string 14. In the preferred embodiment, the legs 40 comprise hydraulically telescoping members such as those generally used in hydraulic jacks and lifts. The hydraulic power for telescoping the legs 40 to raise the retainer (as shown in FIGS. 4 and 5) may be provided by the same hydraulic fluid and pump system used to operate the power tongs. Alternately, the retainer 10 may be raised and lowered using any of a variety of mechanical jacks generally known to those skilled in the mechanical arts for imparting vertical displacement of heavy objects. One alternative jack may include legs 40 that are threaded along their length and threadably coupled to the retainer 10 to impart movement of the retainer 10 by axial rotation of the legs 40, such as with a screw jack. Another alternative jack may include a scissor-lift mechanism for raising the retainer 10. Other alternatives of the present invention may provide a means of lifting the retainer 10 and spider 11 using the elevator 5, which would necessarily also be supporting the entire weight of the pipe string 14.

FIG. 4 is a side elevational view of the preferred embodiment of the vertically reciprocating spider retainer 10 of the present invention, with a spider received therein, with the pipe slips 24 disengaged from the outer surface of the pipe string 14 and as the retainer 10 and the spider 11 are elevated from their floor position towards their raised position. As the legs 40 elongate and the retainer 10 is raised, the threaded coupling 12B may be received into and passed through the internal bore of the spider 11. The angle of dip of the control lines 31 between the control line spools (not shown) and the retainer 10 changes as the retainer 10 elevates from its floor position (shown in FIG. 1) to its raised position (shown in FIG. 5). The angle of dip of the control line changes to a more downwardly angle as the elevation of the retainer 10 and the roller guides 42 and 44 therein is raised relative to the elevation of the control line spools (not shown) that remain on the rig floor 6.

FIG. 5 is a side elevational view of one embodiment of the vertically reciprocating spider retainer 10 of the present invention, with a spider received therein, with the vertically reciprocating spider retainer 10 supporting the spider 11 at its raised position, thereby providing rig personnel 50 access to a portion of the length of the outer surface of the pipe string 14 below the retainer 10 and above the rig floor 6 for installing a control line fastener 34. The telescoping legs 40 are shown at their extreme length. The opening formed between adjacent pairs of elongated legs 40 below the retainer 10 and above the rig floor 6 allows the rig personnel 50 to install a control line fastener 34. The fastener 34 shown in FIG. 5 is a full-enclosure type that substantially surrounds the entire circumference of the pipe string 14 and secures the control lines 31 along the length of the pipe string 14. A safety retainer 48 is engaged with one or more of the legs 40 when the retainer 10 is in its raised position (shown in FIG. 5) to prevent inadvertent lowering of the retainer 10 and injury to the rig personnel 50 installing the fastener 34. In its simplest form, this may be half of a pipe, sectioned lengthwise, secured to a leg 40. Those skilled in the art will appreciate the implementation of a variety of safety devices that may be used to prevent inadvertent collapse or movement of the retainer 10. In some embodiments, such as those having retainers elevated by screw jacks or some types of scissor-lifts, the safety retainer 48 will be either unnecessary or redundant due to the self-locking nature of these devices.

In a preferred embodiment of the present invention shown in FIG. 5, the opening between the rig floor 6 and the base of the retainer 10 when the retainer 10 is in its raised position is approximately 1.5 to 2 meters (shown in FIG. 5), or just enough to permit rig personnel working on the rig floor 6 to access a portion of the outer surface of the pipe string 14 at a location below the retainer 10 and above the rig floor 6. Smaller or larger openings may be employed advantageously as dictated by space or other limitations on the rig floor 6. The horizontal spacing between adjacent legs 40 is generally the same whether the retainer 10 is in its floor position (shown in FIGS. 2 and 3) or in its raised position (shown in FIG. 5). This distance may be about one meter or more as desired to provide stability and support for the retainer 10 when in its raised position (shown in FIG. 5).

As shown in FIG. 5, the length of the portion of the pipe string 14 to which rig personnel are given access by elevating the retainer 10 is determined by the stroke of the hydraulically telescoping legs 40. With the pipe string 14 in the position shown in FIG. 5, the clamp 34 may be installed on the pipe string 14 to secure the control lines 31 along the length of the pipe string 14.

The fastener 34 used to secure the control lines 31 to the pipe string 14 may comprise a clamp, clip, spring, wire, strap, band or any fastener or other device that is suitable for securing a control line 31 to the outer surface of an elongated body such as a pipe string 14. Typically, the inside of the fastener 34 is adapted to fit the cylindrical outer surface of the pipe string 14 to which it is secured, and may be configured with one or more "pockets," or circumferentially upset portions, to accommodate and to secure a control line 31 from circumferential and/or axial movement relative to the outer surface of the pipe string 14 to which the control line 31 is secured. Another mechanical fastener, such as a screw, clip, or a bolt and nut, may be employed to close and tighten the fastener 34 in place on the pipe string 14.

Figure 6:
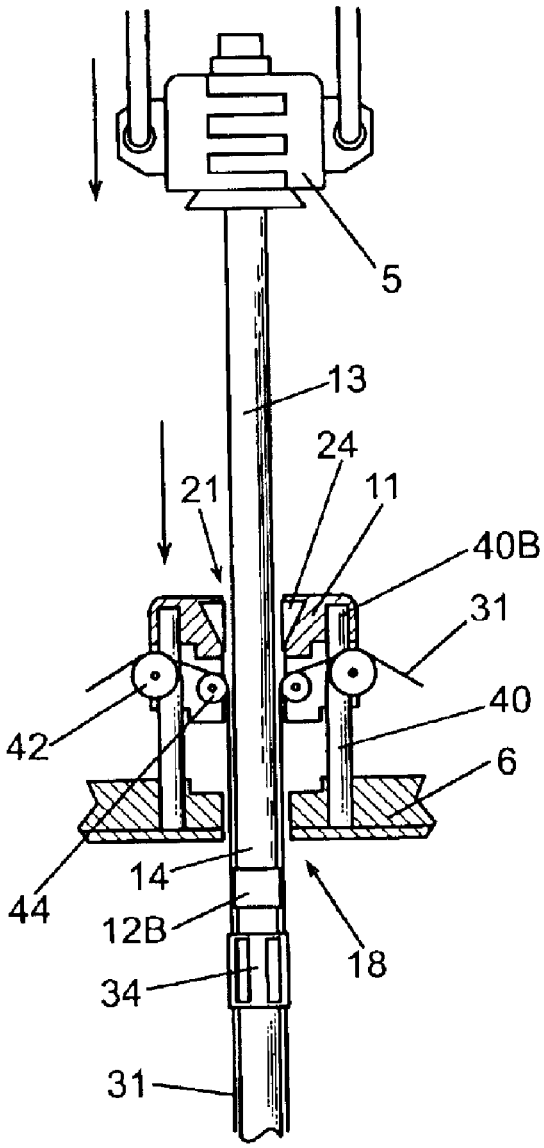
FIG. 6 is a side elevational view of the vertically reciprocating spider retainer of the present invention, with a spider received therein, with the installed fastener securing control lines to the outer surface of the pipe string as the pipe string is lowered into the well and as the retainer and spider are lowered from the raised position to the floor position.

FIG. 6 is a side elevational view of an embodiment of the vertically reciprocating spider retainer 10 of the present invention, with a spider received therein, with the installed fastener 34 securing control lines 31 to the outer surface of the pipe string 14 as the pipe string 14 is lowered into the well through the opening 18 in the rig floor 6 as the retainer 10 and spider 11 are lowered from the raised position (shown in FIG. 5) to the floor position (shown in FIG. 6). After the fastener 34 is applied and the control line 31 is secured to the pipe string 14, the pipe string 14 and control line 31 are lowered into the well through the opening 18 in the rig floor 6. Additional fasteners 34 may be added with each new joint of pipe that is added to the pipe string 14 or, in the alternative, several joints of pipe may be made up into the pipe string 14 before an additional fastener 34 is installed to secure the control line 31 to the pipe string 14.

The mast or other structure (not shown) supporting the hydraulic tongs (not shown) used by rig personnel to make up the pipe string 14 may include a pivoting structure that allows the tongs to be pivoted or otherwise removed from the torqueing position. The mast may be pivoted away from the center axis of the pipe string 14 to be removed from the work area in order to prevent interference between the tongs and the retainer 10 as the retainer 10 is moved from the floor position to the raised position shown in FIG. 5, and the mast may be pivotally returned to the torqueing position after the pipe 13 and the pipe string 14 are lowered into the well through the opening 18 and set in the pipe slips 24 for making up an additional joint of pipe 13.

The roller guides 42 and 44 of the may be adapted for controllably imparting a predetermined direction or path to change the position of the control lines 31 relative to the pipe string 14. It may be appreciated that hydraulic, pneumatic or electrical assemblies may be employed for powering or moving the roller guides or other components of the invention. The control line spool (not shown) and the roller guides 42 and 44 may be adapted for applying a tensioning force to the control lines 31 and to prevent inadvertent over-reeling from the control line spools.

When the control line 31 comprises a bundle of control lines secured one to the others, the control line bundle may be more stiff and inflexible than a single control line 31. The roller guides 42 and 44 may be adapted to assist in bending and redirecting the control line bundle into a parallel position longitudinally along the outer surface of the pipe string 14 suitable for application of a fastener for securing the bundle to the pipe string 14.

While a preferred form of the present invention has been described herein, various modifications of the apparatus and method of the invention may be made without departing from the spirit and scope of the invention, which is more fully defined in the following claims.

What is claimed is:

1. An apparatus for installing a control line and a pipe string in a well, comprising:

a retainer for reciprocating a spider, wherein the spider cast reciprocate without movement of an elevator for supporting the pipe string.

2. The apparatus of claim 1 further comprising a plurality of members for supporting the retainer in a raised position above a rig floor.

3. The apparatus of claim 2 further comprising a means of raising the spider to its raised position.

4. The apparatus of claim 2 wherein a gap is created for providing access to at least a portion of the pipe string beneath the spider in its raised position and above the rig floor for securing the control line to the pipe string.

5. An apparatus for installing a control line and pipe string in well comprising a jack for controllably elevating a spider to a raised position above a rig floor.

6. The apparatus of claim 5 further comprising a plurality of members for supporting the spider above the rig floor.

7. The apparatus of claim 5 further wherein the spider engages the pipe string by radially inwardly movement of a plurality of pipe slips.

8. The apparatus of claim 7 wherein the spider is not engaged with the pipe string when the spider is supported by the jack in the raised position.

9. A method of installing control line and a pipe string in a well, comprising:

transferring support of the pipe string from a spider to an elevator; and reciprocating the spider between a floor position and a raised position while the pipe string is supported by the elevator.

10. The method of claim 9 further comprising disengaging the spider from the pipe string prior to raising the spider to its raised position.

11. The method of claim 9 wherein the spider is not engaged with the pipe string during the step of reciprocating.

12. A method of installing control line and pipe in a well, comprising:

transferring support of the pipe from a spider to an elevator; and controllably raising the spider to a raised position above a rig floor while the pipe is supported by the elevator.

13. The method of claim 12 further comprising supporting a pipe string with an elevator, wherein the spider is supportable in its raised position only when the pipe string is supported by the elevator.

14. The method of claim 13, further comprising lowering the spider to the rig floor.

15. The method of claim 14 further comprising reengaging the spider with the pipe string.

16. The method of claim 12 further comprising raising the spider to the raised position only when the spider is disengaged from the pipe string.

17. A method for securing a control line to a pipe string being run into a well comprising:

transferring support of the pipe string from a spider to an elevator;

raising the spider above a rig floor;

supplying a control line to the pipe string at a location below the spider and above the rig floor;

securing the control line to the pipe string below the spider and above the rig floor; and lowering the pipe string and the control line into the well.

18. An apparatus for installing a control line secured to a pipe string being run into a well, comprising:

a controllably reciprocating retainer for supporting a spider at a raised position above a rig floor to create a gap between the spider and the rig floor;

wherein a fastener is used to secure the control line to the pipe string in a portion of the pipe string adjacent to the gap.

19. The apparatus of claim 18, wherein the spider is adapted for supporting the pipe string only in a lowered position.

20. The apparatus of claim 18, wherein the spider is adapted to reciprocate about a stationary portion of the pipe string above the rig floor.

21. A method of securing a control line to a pipe string being installed in a well comprising the steps of:

supporting a spider in a retainer;

elevating the retainer above a rig floor to form a gap between the retainer and the rig floor;

supporting the pipe string with an elevator whereby the pipe string extends axially through the gap and through an opening in the rig floor into a well;

providing a control line to the pipe string gap formed between the elevated retainer and the rig floor;

securing the control line to a portion of the pipe string adjacent to the gap; and lowering the pipe string and the control line through the rig floor opening and into the well.

22. The method of claim 21 further comprising the step of securing the retainer in its raised position to prevent inadvertent lowering of the retainer into the gap.

23. An apparatus for installing a control line and a pipe string in a well, comprising:

a retainer for reciprocating a spider between a lowered position and a raised position, wherein the apparatus is adapted for supporting the pipe string only in the lowered position.

24. The apparatus of claim 23, wherein the retainer comprises a means for reciprocating the spider about a stationary portion of the pipe string that is above a drill rig floor.

25. The apparatus of claim 23, further comprising at least one support for supporting the retainer in the raised position above the drill rig floor.

26. The apparatus of claim 23, further comprising a means for raising the spider to the raised position when the spider is not supporting the pipe string.

27. The apparatus of claim 26, wherein the retainer is adapted to provide an access to at least a portion of the pipe string between the drill rig floor and the spider in the raised position for securing the control line to the pipe string.

28. The apparatus of claim 27, further comprising means mounted to the retainer for aligning the control line along the portion of the pipe string in the access.

29. The apparatus of claim 23, wherein the retainer comprises means for reciprocating the spider between a lowered position and one or more raised positions.

30. The apparatus of claim 23, wherein the retainer is integral with the spider.

31. The apparatus of claim 23, wherein the retainer supportably receives the spider.

32. A method for securing a control line to a pipe string being run into a well, comprising:

transferring support of the pipe sting from a spider;

raising the spider from a lowered position to a raised position above a drill rig floor;

supplying a control line to the pipe string below the spider and above the rig floor; and lowering the pipe string and the control line into the well.

33. The method of claim 32, further comprising;

transferring support of the pipe string to the spider.

34. The method of claim 32, further comprising:

securing the control line to the pipe string below the spider and above the drill rig floor.

35. The method of claim 32, wherein support of the pipe string is transferred from the spider to an elevator.

* * * * *

UNITED STATES PATENT AND TRADEMARK OFFICE

CERTIFICATE OF CORRECTION

PATENT NO. : 6,889,772 B2
APPLICATION NO. : 10/278718
DATED : May 10, 2005
INVENTOR(S) : Jean Buyaert It is certified that error appears in the above-identified patent and that said Letters Patent is hereby corrected as shown below:

Column 9, in Claim No. 1, line 42 replace the word “cast” with “can.”

Signed and Sealed this

Nineteenth Day of May, 2009

JOHN DOLL
*Acting Director of the United States Patent and Trademark Office*